US006428139B1

(12) United States Patent
Silverbrook

(10) Patent No.: US 6,428,139 B1
(45) Date of Patent: Aug. 6, 2002

(54) INK JET FAULT TOLERANCE USING EXTRA INK DOTS

(75) Inventor: Kia Silverbrook, Balmain (AU)

(73) Assignee: Silverbrook Research Pty Ltd., Balmain (AU)

( * ) Notice: Subject to any disclaimer, the term of this patent is extended or adjusted under 35 U.S.C. 154(b) by 0 days.

(21) Appl. No.: 09/608,777

(22) Filed: Jun. 30, 2000

(51) Int. Cl.[7] ..... B41J 29/393; B41J 2/145
(52) U.S. Cl. ..... 347/19
(58) Field of Search ..... 347/19, 14, 23, 347/41, 42, 15, 10, 11, 12, 43

(56) References Cited

U.S. PATENT DOCUMENTS 5,745,131 A * 4/1998 Kneezel et al. ..... 347/15

FOREIGN PATENT DOCUMENTS

| | | |
|---|---|---|
| EP | 0710005 | 5/1996 |
| EP | 0981105 | 2/2000 |
| EP | 0983855 | 3/2000 |
| WO | WO 96/32272 | 10/1996 |

* cited by examiner

*Primary Examiner*—John Barlow
*Assistant Examiner*—Charles W. Stewart, Jr.

(57) ABSTRACT

A printing method identifies where parts of an image will not be printed due to device failure and if possible prints extra ink dots in adjacent columns so as to lessen the visual effect of failure to print correctly at the original location.

19 Claims, 2 Drawing Sheets

INK JET FAULT TOLERANCE USING EXTRA INK DOTS

FIELD OF THE INVENTION

This invention relates to digital printing and more particularly to printing using devices which eject ink onto the printed substrate. However, the invention is not limited to ink ejection devices and is also applicable to laser, light emitting diode printers and to digital photocopiers.

BACKGROUND OF THE INVENTION

In ink ejection devices a printhead has an array of nozzles through which ink is selectively ejected onto the substrate as the substrate moves relative to the printhead. The printhead may print by scanning across the substrate to print horizontal bands or, if it is a full page width printhead, it may pass along the length of the page. A blocked nozzle will result in multiple horizontal blank lines, in the case of a scanning type printhead, or a blank vertical line in the case of a page width printhead. Such blank lines are undesirable since they detract from the printed result.

The present invention provides a method of modifying the printing of an image so as to reduce or effectively eliminate the visual effect of one or more such blocked nozzles apparent to the eye of an observer in normal use. However, the invention is applicable to other forms of printing where a device, whether passive or active, is repeatedly used to produce dots of ink or the like on a substrate. The invention has potential application to laser and LED type printers and photocopiers where a fault in the imaging drum or light source can result in repeated faults in the image produced. As used above and throughout the description and claims the term image is to be understood to have a broad meaning and includes anything printed, such as text and line drawings.

DISCLOSURE OF THE INVENTION

In one broad form the invention provides a method of modifying an image to be digitally printed by a printing device to compensate for failure to correctly print dots of ink at specific locations, the method including the steps of:

a) identifying said specific location or locations, and b) adding at least one additional dot at at least one additional location adjacent or near to the respective specific location compared to that required by the image data.

In another broad form the invention also provides a printer having a row of activatable devices which, when activated, cause rows of dots to be deposited onto a substrate and means to move the substrate relative to the row of devices in a direction generally perpendicular to the row of dots, said printer including:

means to determine if one or more of said devices is not operating correctly; and control means for analysing images or image data and for identifying a specific location or locations where a dot of ink should be printed by activation of a incorrectly operating device and one or both of the devices on either side of the failed device to produce extra dots of ink compared to that required by the image data.

Extra ink dots may be merely located to the side of the respective specific location if the adjacent location is unused by the image. One or more extra ink dots may be placed to the side and above or below the respective specific location or both above and below the respective specific location. Two or more extra ink dots may be provided in each quadrant relative to the respective specific location.

The extra ink dots may be the same size as those normally required by the image data or may be larger or smaller. Ink dots required by the image data adjacent to where extra dots are printed may be reduced in size to accommodate the extra ink dots. Depending on "normal" ink dot size and spacing and the number and size of extra dots and any change in size of "normal" dots adjacent to the extra dots, the extra dots may overlap with themselves or "normal" dots or both or may be distinct non overlapping dots The extra dots are preferably printed on both transverse sides of the specific locations.

BRIEF DESCRIPTION OF THE DRAWINGS

The invention shall be better understood from the following non-limiting description of preferred embodiments and the drawings, in which.

DESCRIPTION OF PREFERRED AND OTHER EMBODIMENTS

Figure 1:
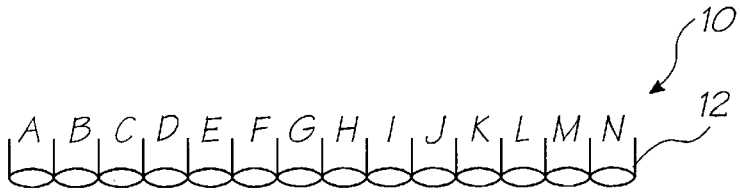
FIG. 1 shows a schematic illustration of a set of nozzles of an ink jet printing head.

Referring to FIG. 1, a printhead 10 has an array of ink jet nozzles 12 arranged in a singe line. For the purpose of explanation only 14 nozzles are shown but in practice there will be from tens to thousands of nozzles arranged in a line. Paper is passed underneath the printhead in a direction generally perpendicular to the line of ink jet nozzles, as indicated by arrow 14. The printhead may be a stationary or a movable printhead. As the paper passes under the printhead the ink jet nozzles A to N are selectively operated to cause an array of ink dots to be placed on the paper. This array is a series of columns and rows, the spacing of which is dependent on the spacing of the inkjet nozzles and the minimum paper feed step respectively. Whilst it is preferred that the horizontal and vertical spacing of the dots is the same, this is not necessarily achievable due to the different sources of the spacing. The printhead may be a page width printhead or a smaller printhead which scans across the page to lay down a series of transverse bands of printing.

For the purposes of explanation it is assumed that inkjets a–g and i–n inclusive are operating correctly but, for whatever reason, inkjet h is not operating correctly or at all. It is also assumed that the diagnostic systems of the printer, which will be well understood by those skilled in the art, have detected that nozzle h is not functioning correctly. In most cases, a malfunctioning device will be partially or totally blocked resulting in insufficient or no ink being deposited on the paper.

Figure 2:
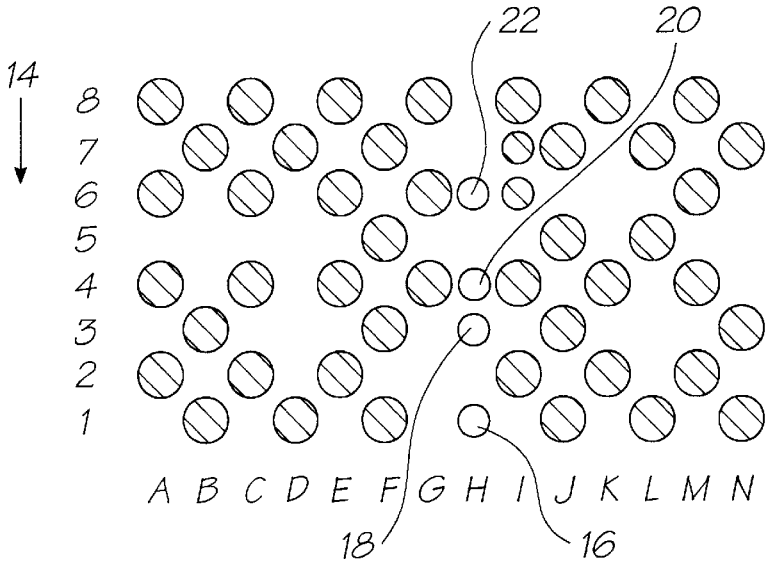
FIG. 2 shows a schematic illustration of an array of ink dots formed by the printhead of FIG. 1 without fault correction operational.
Figure 3:
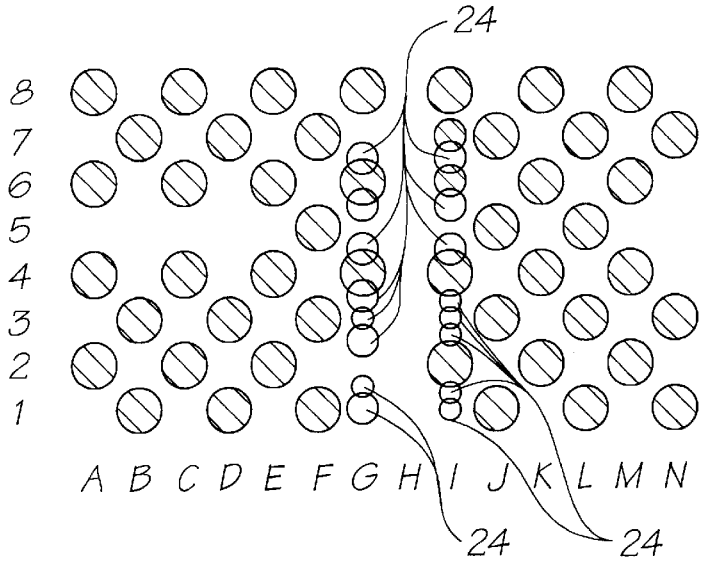
FIG. 3 shows a schematic illustration of the same array of ink dots as in FIG. 2 formed by the printhead of FIG. 1, but with fault correction operational.

Referring to FIG. 2, which schematically shows a portion of printing performed by the printhead 10 without fault correction, there is a blank column, labelled "h" corresponding to inkjet h, whilst columns a–g and i–n have been correctly selectively printed. This leads to one or more blank lines appearing in the printing depending on whether the printhead 10 is a full page width printhead or a scanning type printhead. The unshaded circles numbered 16, 18, 20 and 22 represent drops of ink which should have been printed in column h but were not. FIG. 3 shows the same image printed by the printhead 10 but with fault correction according to an embodiment of the invention operational.

Figure 4:
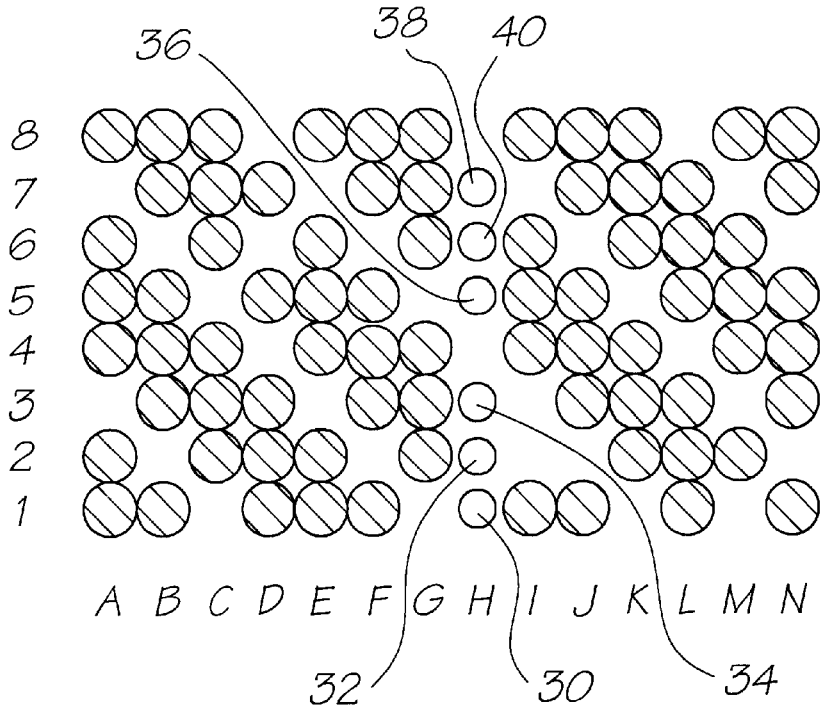
FIG. 4 shows a second schematic illustration of an array of ink dots formed by the printhead of FIG. 1 without fault correction operational.
Figure 5:
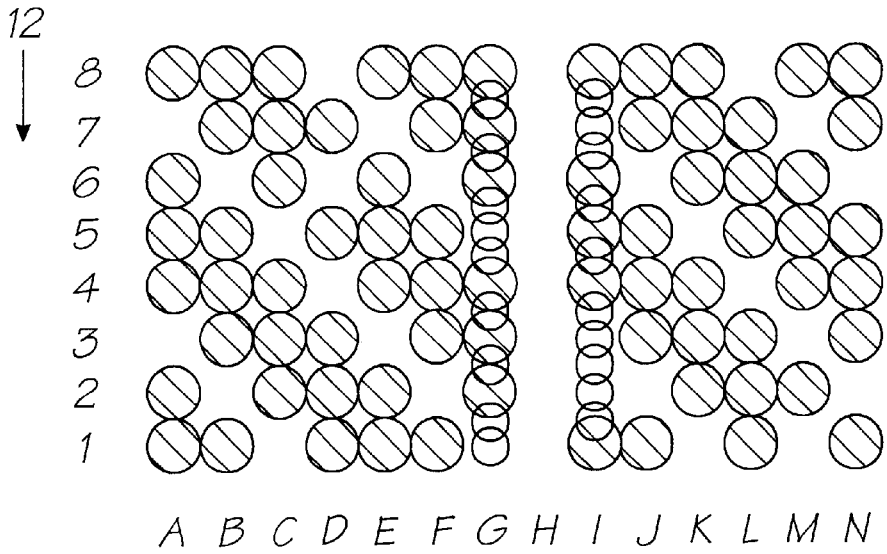
FIG. 5 shows a schematic illustration of the same array of ink dots as in FIG. 4 formed by the printhead of FIG. 1 but with fault correction operational.

Referring to the FIG. 3 the controller causes the devices for columns g and I to be activated at a higher frequency than normal shortly when a dot of ink should be deposited in column h. This results in there being extra dots produced, and deposited between the normal rows of dots as indicated by the dots numbered 24. Depending on the row spacing, the extra dots may overlap the "normal" dots in the rows above and below the extra dots or the extra dots may be separate from the rows above and below. In the FIGS. 2 and 3 prints dots are required in column h at only about 50% of possible locations. The controller thus only causes extra dots to be produced before and after each row in which a dot in row h should have been printed. However, this may be increased to more then one row before or after or both. Further, if no dot is required to be produced in the adjacent column the controller may cause an extra dot to be produced in the "normal" position of the relevant column as well as additional dots between the "normal" rows. This can be seen at column g, rows 1 and 3 of FIG. 3 where extra dots have been printed in the "normal" positions. FIG. 4 shows a print where dots 30, 32, 34, 36, 38 and 40 are required in column h, ie six dots in eight rows. FIG. 5 shows the result with fault correction operational. It can be seen, in columns g and I that extra dots have been produced between every "normal" row and that the extra dots have also been produced at "normal" locations. This creates a continuous overlapping array of normal and extra dots in columns g and I and so significantly reduces the white space caused by failure to print in column h.

Depending on the performance characteristics of the actuator the extra dots may be the same size as the "normal" dots or may be larger or smaller, as desired or as necessary. For example, a mechanical ink ejector may capable of being operated at 50 KHz, ie expelling 50,000 drops of ink per second. The ejector may be used in a "domestic" type printer where, due to paper feed speeds, for example, it is only necessary to be run at 25 KHz. Thus, individual ejectors may be run at 50 KHz to produce dots between rows without decreasing the dot size.

Even if the normal activator frequency is more than half the "maximum" design frequency for the printhead as a whole, individual ink ejectors may be activated at twice the frequency. In a micro mechanical ink ejector, which relies on thermal bending, it may be necessary to reduce the pulse width and/or voltage of the driving signal so that the micro mechanical ejector has returned to its normal rest state and/or the ink reservoir has refilled before commencement of the next "normal" drop ejection cycle. A reduced pulse width/voltage will result in a smaller extra dot being formed. Alternatively the ejector may be activated with the pulse width and voltage of the driving signal unchanged. This will result in either of the actuator not returning to its rest position or the ink reservoir not refilling before commencement of the rest cycle, or both. This will result in smaller drops for dots in both the "normal" rows and the extra rows. However the effect is still satisfactory.

It will be appreciated that this technique is applicable to other digital printing techniques where the image producing system may be cycled faster than normal. For instance a laser printer may have a high scan speed of the laser beam across the imaging drum such that less than 1 in two scans are actually used. The unused scans may be used to produce extra dots. Similarly a light emitting device type printer may cycle the light emitting devices at a higher than normal frequency to achieve the same result.

Also, within the scope of the invention is the printing of oversize dots in unshifted locations next to or adjacent the unprinted location and/or the printing of extra dots between the rows adjacent or next to the unprinted location.

Whilst the techniques described only consider rows printed after the original row in determining where to place dots, it will be appreciated that a look ahead feature may also be utilised to place dots in rows printed before the original row. For example, if using the look behind criteria a dot should be placed to the right of the failed nozzle, but looking ahead it is apparent that dots will be normally required in that column for the next few rows, then a better result may be to place the dot in the left hand column of the original row. Similarly, the embodiments described may also translate the dot to the next row printed after the normally desired position. By using a look ahead feature the dot may be printed in the row before the normally desired position if a better result will occur.

It will also be appreciated that this technique may be used with laser and LED printers and photocopiers and other types of digital printers where the placement of an ink dot is dependent on individual activation of a device or component. For example, an LED in a LED printer may fail or there may be a defect in the photoconductive imaging drum of a laser printer. In both cases, shifting of dots can hide or reduce the visual effect of the defect in the device or component.

I claim:

1. A method of modifying an image to be digitally printed by a printing device to compensate for failure to correctly print dots of ink at specific locations, the method including the steps of:

a) identifying said specific location or locations, and b) adding at least one additional dot at at least one additional location adjacent or near to the respective specific location compared to that required by the image data.

2. The method of claim 1 wherein the at least one additional location is located transversely of the specific location.

3. The method of claim 1 wherein the at least one additional location is located longitudinally of the specific location.

4. The method of claim 1 wherein said dots are printed in rows and the at least one additional location is located between said rows.

5. The method of claim 1 wherein said dots are printed in rows and at least two additional locations are located between adjacent rows for each specific location.

6. The method of claim 1 wherein said dots are printed in rows and at least two additional locations are located between adjacent rows to the same side of each specific location.

7. The method of claim 1 wherein said dots are printed in rows and columns and the at least one additional location is located in one or both columns on either side of the specific location and between said rows.

8. The method of claim 1 wherein the dot size of a dot at an additional location is the same as the size of a dot at a location required by the image data.

9. The method of claim 1 wherein the dot size of a dot at an additional location is less than the size of a dot at a location required by the image data.

10. The method of claim 1 wherein the dot size of a dot at a location required by the image data adjacent to an additional location is less than that required by the image data.

11. A printer having a row of activatable devices which, when activated, cause rows of dots to be deposited onto a substrate and means to move the substrate relative to the row of devices in a direction generally perpendicular to the row of dots, said printer including:

means to determine if one or more of said devices is not operating correctly; and control means for analysing images or image data and for identifying a specific location or locations where a dot of ink should be printed by activation of a incorrectly operating device and one or both of the devices on either side of the failed device to produce extra dots of ink compared to that required by the image data.

12. The printer of claim 11 wherein the control means adjusts the size of dots deposited in the same row as the respective specific location by one or both of the devices on either side of the failed device.

13. The printer of claim 11 wherein the control means adjusts the size of dots deposited by one or both of the devices on either side of the failed device at least one row adjacent or near to the row of the respective specific location.

14. The printer of claim 11 wherein if no dot or an undersized dot is produced by activation of the incorrectly operating device the size of dots produced by activation of one or both of the devices adjacent to the incorrectly operating device is increased.

15. The printer of claim 11 wherein the devices are thermo mechanical ink ejection devices and said control system causes the ejection devices to be activated for a longer period of time or supplies a larger driving signal, or both.

16. The printer of claim 11 wherein said devices are light emitting devices and wherein the amount of light emitted by said light emitting devices is adjusted.

17. The printer of claim 11 wherein said devices are portions of a photoconductive imaging drum and the dot size of said adjusted dots is adjusted by varying the amount of light the respective device is exposed to.

18. The printer of claim 11 wherein at least some oversize adjusted dots contact or overlap with adjacent dots.

19. The printer of claim 11 wherein adjusted size dots do not overlap contact with adjacent dots.

* * * * *